US007665959B2

(12) United States Patent
Giaimo et al.

(10) Patent No.: US 7,665,959 B2
(45) **Date of Patent: *Feb. 23, 2010**

(54) RACK AND PINION VARIABLE VANE SYNCHRONIZING MECHANISM FOR INNER DIAMETER VANE SHROUD

(75) Inventors: John A. Giaimo, Weston, FL (US); John P. Tirone, III, Moodus, CT (US)

(73) Assignee: United Technologies Corporation, Hartford, CT (US)

( * ) Notice: Subject to any disclaimer, the term of this patent is extended or adjusted under 35 U.S.C. 154(b) by 528 days.

This patent is subject to a terminal disclaimer.

(21) Appl. No.: 11/185,622

(22) Filed: Jul. 20, 2005

(65) Prior Publication Data

US 2007/0020090 A1 Jan. 25, 2007

(51) Int. Cl.
*F01D 17/16* (2006.01)

(52) U.S. Cl. ..... 415/160

(58) Field of Classification Search ..... 415/150, 415/159–166

See application file for complete search history.

(56) References Cited

U.S. PATENT DOCUMENTS

| | | | | |
|---|---|---|---|---|
| 2,233,983 | A * | 3/1941 | Kice, Jr. | 415/160 |
| 2,805,818 | A * | 9/1957 | Ferri | 415/160 |
| 2,994,509 | A * | 8/1961 | Walker | 415/159 |
| 3,025,036 | A * | 3/1962 | Kumm et al. | 415/160 |
| 3,314,654 | A * | 4/1967 | Thenault et al. | 415/160 |
| 3,352,537 | A * | 11/1967 | Petrie | 415/160 |
| 3,632,224 | A * | 1/1972 | Wright et al. | 415/159 |
| 3,816,021 | A * | 6/1974 | Lewis et al. | 415/163 |
| 4,044,815 | A | 8/1977 | Smashey et al. | |
| 4,834,613 | A | 5/1989 | Hansen et al. | |
| 5,024,580 | A | 6/1991 | Olive | |
| 5,039,277 | A | 8/1991 | Naudet | |
| 5,380,152 | A * | 1/1995 | Sikorski et al. | 415/160 |
| 5,630,701 | A * | 5/1997 | Lawer | 415/160 |
| 6,283,705 | B1 * | 9/2001 | Rice et al. | 415/160 |
| 6,321,449 | B2 | 11/2001 | Zhao et al. | |
| 6,413,043 | B1 | 7/2002 | Bouyer | |
| 6,843,638 | B2 | 1/2005 | Hidalgo et al. | |
| 2003/0113204 | A1 * | 6/2003 | Wolf | 415/165 |

* cited by examiner

*Primary Examiner*—Christopher Verdier
(74) *Attorney, Agent, or Firm*—Kinney & Lange, P.A.

(57) ABSTRACT

An inner diameter vane shroud of a variable vane assembly accommodates a synchronization mechanism for coordinating rotation of an array of variable vanes. The inner diameter vane shroud has a gear track that runs circumferentially through the vane shroud. An array of variable vanes is rotatably mounted in the vane shroud at an inner end. Each vane has a gear pinion at its inner end, which interfaces with the gear track. As one of the individual variable vanes is rotated by an actuation source, the other variable vanes of the variable vane array are rotated a like amount by the rack and pinion gear interface.

6 Claims, 4 Drawing Sheets

RACK AND PINION VARIABLE VANE SYNCHRONIZING MECHANISM FOR INNER DIAMETER VANE SHROUD

This invention was made with U.S. Government support under contract number N00019-02-C-3003 awarded by the United States Navy, and the U.S. Government may have certain rights in the invention.

CROSS-REFERENCE TO RELATED APPLICATION(S)

The present application is related to the following copending applications filed on the same day as this application: "SYNCH RING VARIABLE VANE SYNCHRONIZING MECHANISM FOR INNER DIAMETER VANE SHROUD" by inventors J. Giaimo and J. Tirone III (Ser. No. 11/185,623); "GEAR TRAIN VARIABLE VANE SYNCHRONIZING MECHANISM FOR INNER DIAMETER VANE SHROUD" by inventors J. Giaimo and J. Tirone III (Ser. No. 11/185,624); "INNER DIAMETER VARIABLE VANE ACTUATION MECHANISM" by inventors J. Giaimo and J. Tirone III (Ser. No. 11/185,995); and "LIGHTWEIGHT CAST INNER DIAMETER VANE SHROUD FOR VARIABLE STATOR VANES" by inventors J. Giaimo and J. Tirone III (Ser. No. 11/185,956). All of these applications are incorporated herein by this reference.

BACKGROUND OF THE INVENTION

This invention relates generally to gas turbine engines and more particularly to variable stator vane assemblies for use in such engines.

Gas turbine engines operate by combusting a fuel source in compressed air to create heated gases with increased pressure and density. The heated gases are ultimately forced through an exhaust nozzle, which is used to step up the velocity of the exiting gases and in-turn produce thrust for driving an aircraft. The heated gases are also used to drive a turbine for rotating a fan to provide air to a compressor section of the gas turbine engine. Additionally, the heated gases are used to drive a turbine for driving rotor blades inside the compressor section, which provides the compressed air used during combustion. The compressor section of a gas turbine engine typically comprises a series of rotor blade and stator vane stages. At each stage, rotating blades push air past the stationary vanes. Each rotor/stator stage increases the pressure and density of the air. Stators serve two purposes: they convert the kinetic energy of the air into pressure, and they redirect the trajectory of the air coming off the rotors for flow into the next compressor stage.

The speed range of an aircraft powered by a gas turbine engine is directly related to the level of air pressure generated in the compressor section. For different aircraft speeds, the velocity of the airflow through the gas turbine engine varies. Thus, the incidence of the air onto rotor blades of subsequent compressor stages differs at different aircraft speeds. One way of achieving more efficient performance of the gas turbine engine over the entire speed range, especially at high speed/high pressure ranges, is to use variable stator vanes which can optimize the incidence of the airflow onto subsequent compressor stage rotors.

Variable stator vanes are typically circumferentially arranged between an outer diameter fan case and an inner diameter vane shroud. Traditionally, mechanisms coordinating the synchronized movement of the variable stator vanes have been located on the outside of the fan case. These systems increase the overall diameter of the compressor section, which is not always desirable or permissible. Also, retrofitting gas turbine engines that use stationary stator vanes for use with variable stator vanes is not always possible. Retrofit variable vane mechanisms positioned outside of the fan case interfere with other external components of the gas turbine engine located on the outside of the fan case. Relocating these other external components is often impossible or too costly. Synchronizing mechanisms also add considerable weight to the gas turbine engine. Thus, there is a need for a lightweight variable vane synchronizing mechanism that does not increase the diameter of the compressor section and does not interfere with other external components of the gas turbine engine.

BRIEF SUMMARY OF THE INVENTION

In the present invention, an inner diameter vane shroud accommodates a synchronizing mechanism for coordinating rotation of an array of variable vanes. The inner diameter vane shroud has a gear track that runs circumferentially through the vane shroud. An array of variable vanes is rotatably mounted in the vane shroud at an inner end. Each variable vane includes a gear pinion at its inner end, which interfaces with the gear track. As one of the individual variable vanes is rotated by an actuation source, the other variable vanes of the variable vane array are rotated a like amount by the rack and pinion gear interface.

DETAILED DESCRIPTION

Figure 1:
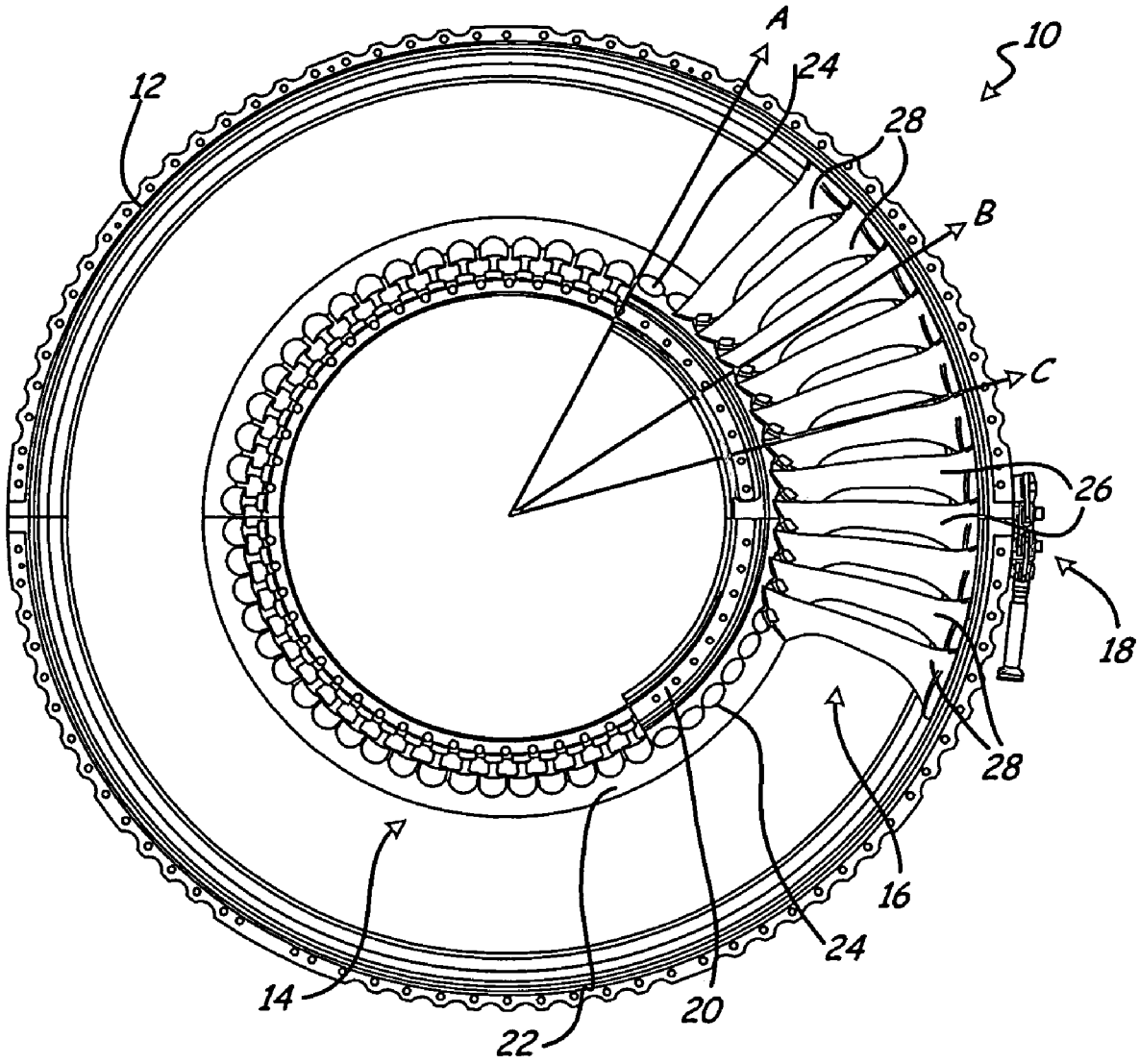
FIG. 1 shows a partially cut away front view of a stator vane section of a gas turbine engine in which the present invention is used.

FIG. 1 shows a partially cut away front view of stator vane section 10 of a gas turbine engine in which the present invention is used. Stator vane section 10 comprises fan case 12, vane shroud 14, variable vane array 16 and actuator 18. Vane shroud 14 is comprised of forward vane shroud component 20 and aft vane shroud component 22, which form inner diameter vane sockets 24. A half-socket, or a recess, is located on each of forward vane shroud component 20 and aft vane shroud component 22 to form socket 24. In FIG. 1, only a portion of forward vane shroud component 20 is shown so that the interior of sockets 24 can be seen.

Variable vane array 16 is comprised of drive vanes 26 and a plurality of follower vanes 28. Drive vanes 26 and follower vanes 28 are connected inside inner diameter vane shroud 14 by the rack and pinion variable vane synchronizing mechanism of the present invention. Thus, when actuator 18 rotates drive vanes 26, follower vanes 28 rotate a like amount.

Typically, follower vanes 28 encircle the entirety of vane shroud 14. For clarity, only a portion of variable vane array 16 is shown so that sockets 24 can be seen. Drive vanes 26 and follower vanes 28 are rotatably mounted at the outer diameter of stator vane section 10 in fan case 12, and at the inner diameter of stator vane section 10 in vane shroud 14. The number of drive vanes 26 varies in other embodiments and can be as few as one. In one embodiment, variable vane array 16 includes fifty-two follower vanes 28 and two drive vanes 26. Drive vanes 26 are similar in construction to follower vanes 28 comprising variable vane array 16. In one embodiment, drive vanes 26 are of heavy duty construction to withstand forces applied by actuator 18.

Inner diameter vane shroud 14 can be constructed in component sizes less than the entire circumference of inner diameter vane shroud. In one embodiment, as shown in FIG. 1, forward vane shroud component 20 is made of sections approximately one sixth (i.e. 60°) of the circumference of inner diameter vane shroud 14. In such a case, two sections have nine half-sockets 24 and one section has eight half-sockets 24. Smaller forward vane shroud components 20 assist in positioning forward vane shroud component 20 under the inner diameter ends of drive vanes 26 and follower vanes 28 when they are inserted in sockets 24. In one embodiment for use in split fan case designs, aft vane shroud component 22 is made of sections approximately one half (i.e. 180°) the circumference of inner diameter vane shroud 14, in which case each section has twenty six half-sockets 24. The rack and pinion variable vane synchronizing mechanism of the present invention is constructed in smaller segments, such as approximately one half (i.e. 180°) segments, for use in split fan case designs. Additionally, in other embodiments, the forward vane shroud component 20 and aft vane shroud component 22 can be made as full rings (i.e. 360°), along with the rack and pinion variable vane synchronizing mechanism, for use in full ring fan case designs.

Stator vane section 10 is typically located in a compressor section of a gas turbine engine downstream of, or behind, a rotor blade section. Air is forced into stator vane section 10 by a preceding rotor blade section or by a fan. The air that passes through stator vane section 10 typically passes on to an additional rotor blade section. Drive vanes 26 and follower vanes 28 rotate along their respective radial positions in order to control the flow of air through the compressor section of the gas turbine engine. The rack and pinion variable vane synchronizing mechanism of the present invention coordinates their rotation.

Figure 2A:
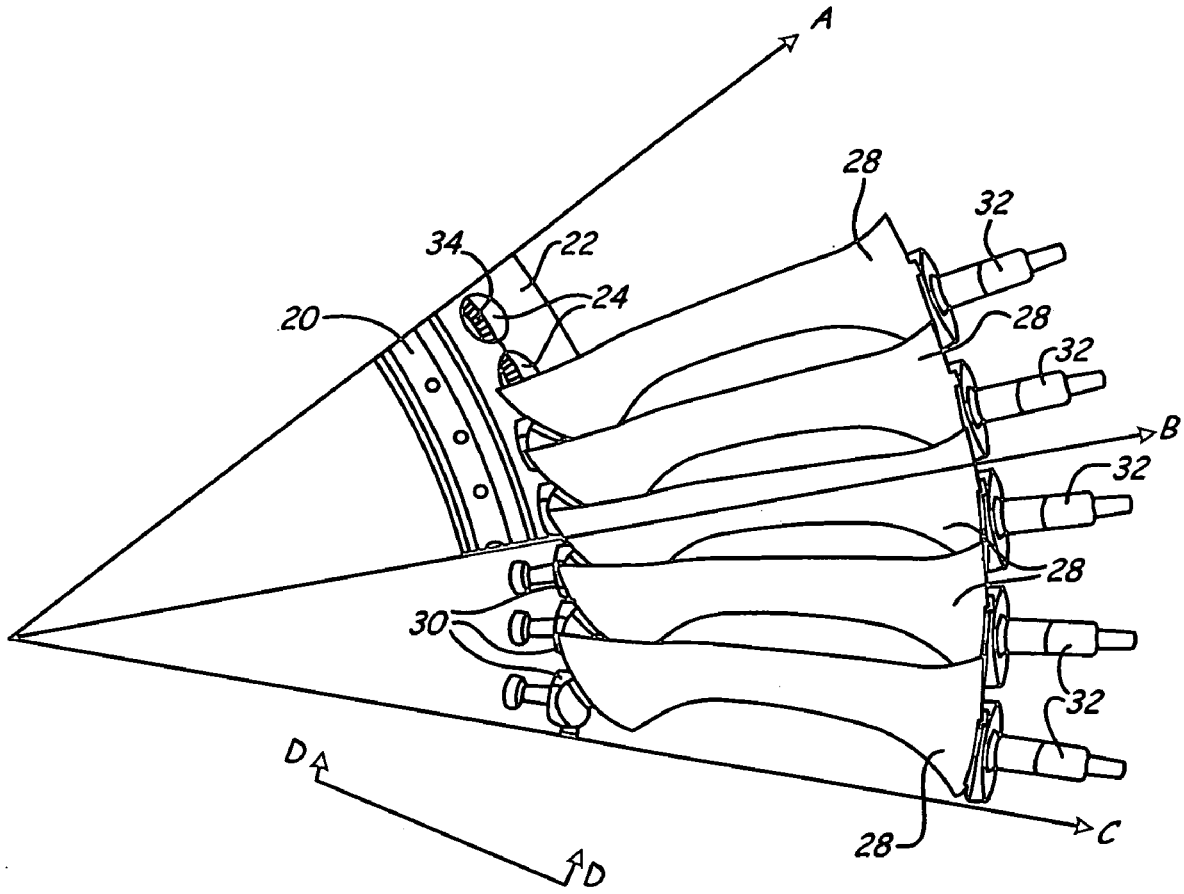
FIG. 2A shows a front view of a segment of the stator vane section of FIG. 1 between arrows A and C, with the inner diameter vane shroud removed between arrows B and C and the fan case removed.

FIG. 2A shows a front view of a segment of stator vane section 10 of FIG. 1 between arrows A and C, with the inner diameter vane shroud removed between arrows B and C and the fan case removed. Inner diameter vane shroud 14 is comprised of forward vane shroud component 20 and aft vane shroud component 22. Forward vane shroud component 20 and aft vane shroud component 22 together form sockets 24 for receiving inner diameter trunnions 30 of follower vanes 28. Follower vanes 28 include outer diameter trunnions 32 for rotating in bosses of fan case 12 (shown in FIG. 1). The rack and pinion synchronizing mechanism of the present invention is located on the inside of inner diameter vane shroud 14. Rack and pinion synchronizing mechanism includes gear rack 34, which can be seen in sockets 24. Gear rack 34 is slidably positioned in aft vane shroud component 22 at a level at which it can interface with inner diameter trunnions 30.

Figure 2B:
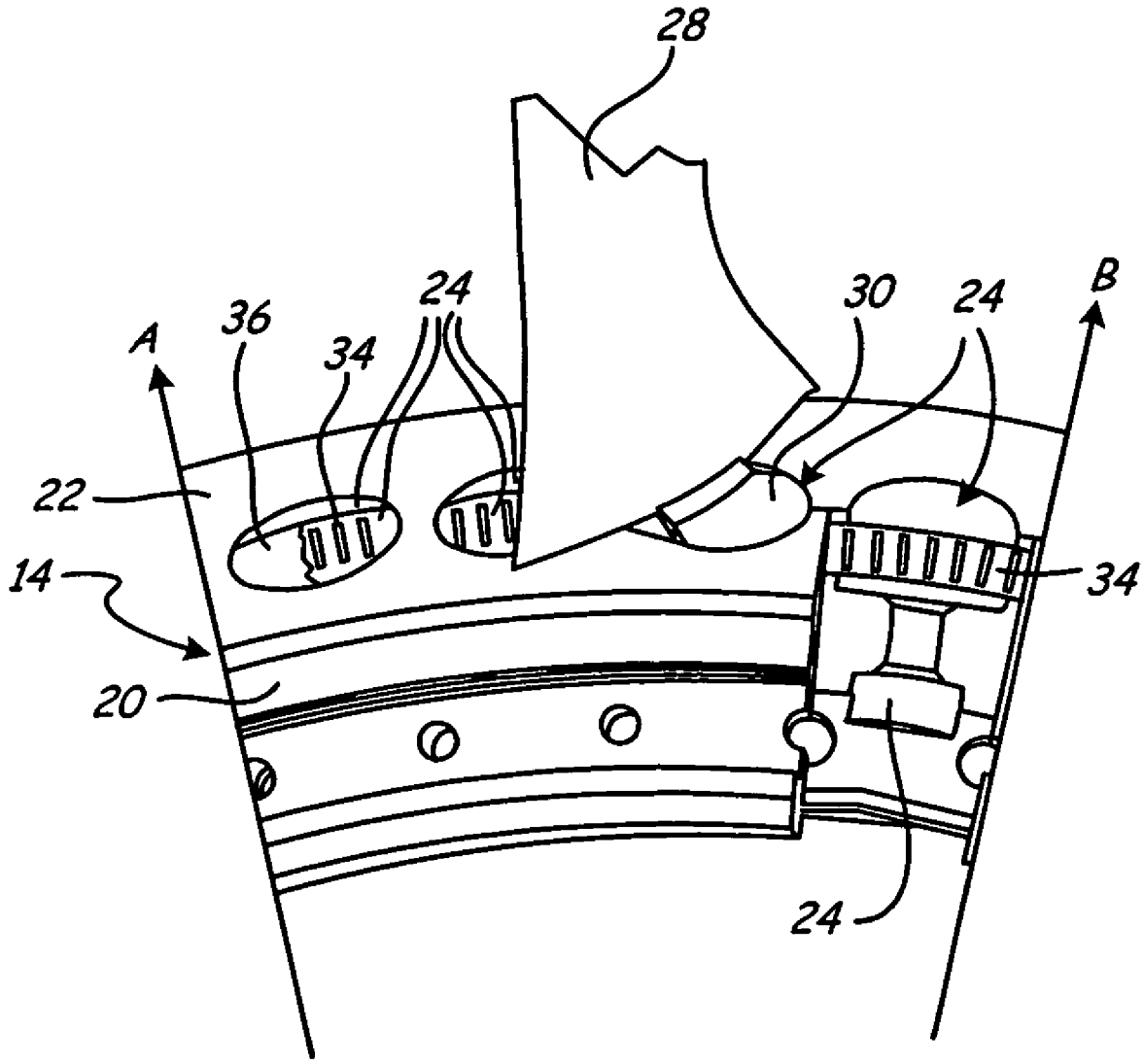
FIG. 2B shows a partially cut away front view of a segment of the inner diameter vane shroud between arrows A and B of FIG. 1.

FIG. 2B shows a partially cut away front view of a segment of inner diameter vane shroud 14 between arrows A and B of FIG. 1. The rack and pinion synchronizing mechanism is comprised of gear rack 34 and gear track 36. Gear track 36 is located on a forward facing surface of aft vane shroud component 22. Inner diameter trunnion 30 of follower vane 28 is inserted into socket 24 of inner diameter vane shroud 14. The cut away portion of forward vane shroud component 20 reveals the inside of socket 24. Socket 24 has a profile that matches that of inner diameter trunnion 30 so that inner diameter trunnion 30 locks into assembled inner diameter vane shroud 14, yet remains able to rotate in socket 24. Gear track 36 cuts through aft vane shroud component 22 at a level running through socket 24 so gear rack 34 interfaces with inner diameter trunnion 30. Gear rack 34 is slidably located in gear track 36 with its gear teeth facing in the forward direction so they can interface with pinion gears of inner diameter trunnions 30. In one embodiment, gear rack 34 and gear track 36 extend the entire circumference of inner diameter vane shroud 14 to form a single continuous rack and track segment (i.e. 360°). In other embodiments, gear rack 34 and gear track 36 can be constructed in smaller segments, such as approximately one half (i.e. 180°) segments, for use in split fan case designs.

Figure 3A:
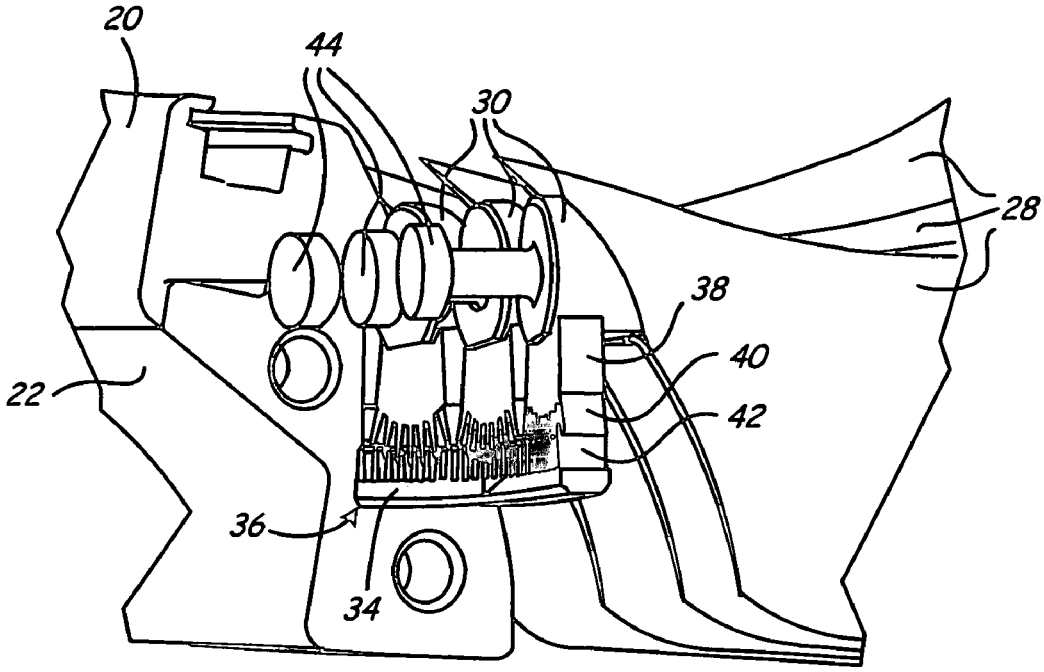
FIG. 3A shows a close-up of the rack and pinion mechanism of the present invention shown from the vantage of line D-D in FIG. 2A.

FIG. 3A shows a close-up of the rack and pinion mechanism of the present invention shown from the vantage of line D-D in FIG. 2A. Forward vane shroud component 20 and aft vane shroud component 22 comprise inner diameter vane shroud 14. Gear rack 34 includes rack gear teeth 42. Inner diameter trunnions 30 include pinion gears 38 that include arcuate gear teeth segments 40. Inner diameter trunnions 30 also include buttons 44, which are used to pivotably secure follower vanes 28 inside sockets 24.

Pinion gears 38 are located on an aft facing portion of inner diameter trunnions 30. Pinion gears 38 are positioned along inner diameter trunnions 30 such that pinion gears 38 are insertable in gear track 36. Pinion gears 38 include arcuate gear teeth segments 40 that interface with rack gear teeth 42. Gear rack 34 is free to slide in gear track 36, which extends into the circumference of vane shroud 14. Gear track 36 comprises a three-sided rack channel formed internally between forward vane shroud component 20 and aft vane shroud component 22. Gear track 36 is formed into an internal surface of aft vane shroud component 22 to receive gear rack 34 and open towards pinion gears 38. Gear rack 34 is able to continuously rotate the entire circumference of vane shroud 14 within gear track 36. Rack gear teeth 42 run the entire forward facing circumference of gear rack 34.

Figure 3B:
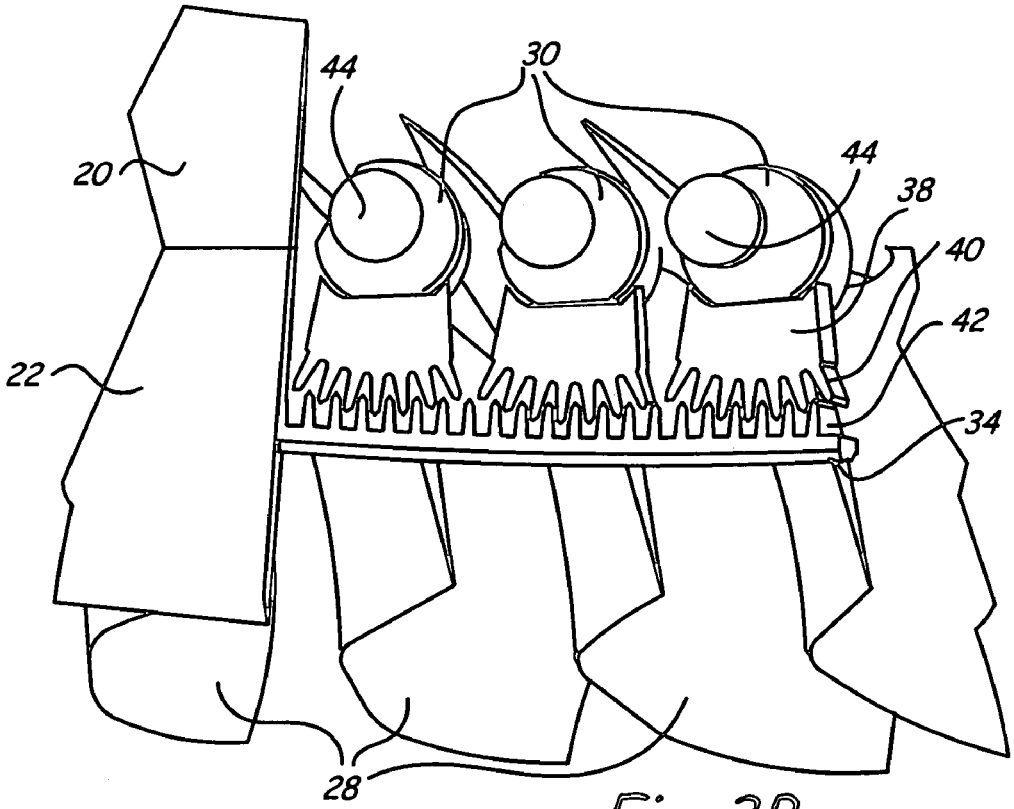
FIG. 3B shows approximately a bottom view of the rack and pinion mechanism of FIG. 2A shown from the vantage of the center of the stator vane section looking out.

FIG. 3B shows approximately a bottom view of the rack and pinion mechanism of FIG. 2A shown from the vantage of the center of the stator vane section 10 looking out. Inner diameter vane shroud 14 comprises forward vane shroud component 20 and aft vane shroud component 22, which clamp around inner diameter trunnions 30 and gear rack 34. Rack gear teeth 42 and arcuate gear teeth segments 40 mesh together when forward vane shroud component 20 and aft vane shroud component 22 are coupled together with rack and pinion synchronizing mechanism. Only a portion of the teeth of arcuate gear teeth segments 40 mesh with rack gear teeth 42 at any time. This allows follower stator vanes 28 to rotate and to maintain a gear tooth interface at all times. In the embodiment shown in FIG. 3B, the teeth located toward the center of arcuate gear tooth segment 40 mesh with rack gear teeth 42 when follower stator vanes 28 are in their centered or zeroed position. The center position can vary, depending on design requirements, depending on their orientation when linked to actuator 18.

Gear rack 34 is slidably contained in inner diameter vane shroud 14. Gear rack 34 synchronizes the rotation of follower stator vanes 28 when drive vanes 26 are rotated by actuator 18. For example, if drive vanes 28 are rotated clockwise (as shown in FIG. 3B), gear rack 34 will be pushed to the left. Gear rack 34 will in-turn push pinion gears 38 to the left through rack gear teeth 42 and arcuate gear tooth segments 40. This causes follower stator vanes 28 of stator vane array 16 to likewise rotate in a clockwise direction. Thus, the direction of the flow of air exiting stator vane section 10 can be controlled for entry into the next section of the gas turbine engine utilizing the rack and pinion variable vane synchronizing mechanism.

Gear rack 34 and pinion gears 38 connect all follower stator vanes 28 similarly, such that the selection of drive vanes 26 can be made from any of the array of follower vanes 28. In one embodiment, follower vanes 28 selected to be the drive vane can be of a heavy duty construction to withstand forces applied by actuator 18.

The amount of rotation of drive vanes 26 and follower vanes 28 depends on the length of the actuation stroke, the number of teeth used, the amount of curvature of arcuate gear tooth segments 40, and other factors that are known in the art. The invention can be tailored to specific design requirements by varying these factors.

Although the present invention has been described with reference to preferred embodiments, workers skilled in the art will recognize that changes may be made in form and detail without departing from the spirit and scope of the invention.

The invention claimed is:

1. A variable vane shroud mechanism for use in a turbine engine, the vane shroud mechanism comprising:

an inner diameter vane shroud for receiving inner diameter ends of an away of variable vanes, the shroud comprising:

a plurality of radially extending vane sockets;

an internal synchronizing cavity extending circumferentially across a width of the vane shroud adjacent the plurality of sockets;

an arcuate body portion comprising a forward shroud component and an aft shroud component each comprising:

a mating surface comprising:

a plurality of partial vane sockets; and an internal surface defining a portion of the internal synchronizing cavity;

wherein the mating surfaces of the forward and aft shroud components mate such that the plurality of partial vane sockets form the plurality of radially extending sockets, and the internal surfaces form the internal synchronizing cavity; and a three-sided gear track extending axially from the plurality of partial vane sockets on the aft shroud component, the internal surface of the aft shroud component comprising a portion of the gear track; and a synchronizing mechanism positioned internally within the variable vane shroud to interface with the inner diameter ends of the away of variable vanes such that rotation of individual variable vanes comprising the away of variable vanes is coordinated.

2. A variable vane assembly comprising:

an inner diameter vane shroud comprising:

an arcuate shroud body;

a plurality of sockets extending radially into an interior of the shroud body; and a rack channel extending circumferentially through an interior of the shroud body and intersecting the plurality of sockets;

a drive vane comprising:

an inner diameter trunnion rotatably disposed in one of the plurality of sockets in the inner diameter vane shroud; and a pinion extending axially from the trunnion that rides within the rack channel;

a plurality of follower vanes each comprising:

an inner diameter trunnion rotatably disposed in one of the plurality of sockets in the inner diameter vane shroud; and a pinion extending axially from the trunnion that rides within the rack channel; and an arcuate gear rack slidably located in the rack channel within the interior of the arcuate shroud body to interface with the pinions of the drive vane and the follower vanes such that when the drive vane is rotated an amount, the plurality of follower vanes are rotated a like amount by the gear rack.

3. The variable vane assembly of claim 2 wherein the inner diameter vane shroud comprises a forward vane shroud component and an aft vane shroud component.

4. The variable vane assembly of claim 3 wherein the aft shroud component includes a three-sided rack channel.

5. The variable vane assembly of claim 2 wherein the drive vane and each of the follower vanes include a button positioned radially inward from the inner diameter trunnion to secure the vanes within the interior of the inner diameter vane shroud.

6. The variable vane assembly of claim 2 wherein the interior rack channel bounds the pinions and the gear rack to prevent radial and axial disengagement of the pinions from the gear rack.

* * * * *

UNITED STATES PATENT AND TRADEMARK OFFICE

CERTIFICATE OF CORRECTION

PATENT NO. : 7,665,959 B2
APPLICATION NO. : 11/185622
DATED : February 23, 2010
INVENTOR(S) : John A. Giaimo et al.

It is certified that error appears in the above-identified patent and that said Letters Patent is hereby corrected as shown below:

In Claim 1, Column 5, Line 30, delete "away", insert --array--

In Claim 1, Column 6, Line 5, delete "away", insert --array--

In Claim 1, Column 6, Line 6, delete "away", insert --array--

Signed and Sealed this

Twenty-fifth Day of May, 2010

David J. Kappos

David J. Kappos
*Director of the United States Patent and Trademark Office*